US007044783B2

(12) United States Patent
Fan

(10) Patent No.: US 7,044,783 B2
(45) Date of Patent: May 16, 2006

(54) ELECTRICAL SYSTEM WITH DEVICE FOR PREVENTING ELECTROSTATIC DISCHARGE

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/104,994

(22) Filed: Apr. 12, 2005

(65) Prior Publication Data

US 2006/0014422 A1 Jan. 19, 2006

(30) Foreign Application Priority Data

Jul. 16, 2004 (TW) ..... 93211261

(51) Int. Cl.
*H01R 13/60* (2006.01)

(52) U.S. Cl. ..... 439/567

(58) Field of Classification Search ..... 439/567, 439/79, 7.1, 83, 101, 541.5, 629–632, 607–610; 361/752, 816, 818
See application file for complete search history.

(56) References Cited

U.S. PATENT DOCUMENTS

| | | | | |
|---|---|---|---|---|
| 5,356,300 | A | 10/1994 | Costello et al. | |
| 6,736,676 | B1 * | 5/2004 | Zhang et al. | 439/607 |
| 6,954,363 | B1 * | 10/2005 | Fan | 361/816 |
| 2002/0142651 | A1 * | 10/2002 | Hashimoto et al. | 439/567 |
| 2002/0177336 | A1 | 11/2002 | Sasame et al. | |
| 2003/0077929 | A1 | 4/2003 | Funatus | |
| 2004/0097128 | A1 * | 5/2004 | Wu | 439/567 |

FOREIGN PATENT DOCUMENTS

CN 1291808 4/2001

* cited by examiner

*Primary Examiner*—J. F. Duverne
(74) *Attorney, Agent, or Firm*—Wei Te Chung

(57) ABSTRACT

An electrical system includes a first connector (1), a second connector (2), and a printed circuit board (PCB) on which the second connector is mounted. The first connector has a mating portion (112) with numbers of contacts (13) therein and an elastic post member (14) standing higher than the mating portion. The second connector defines a mating connector fitting section (212) with numbers of contacts (23) therein and a through hole (217) for guiding and receiving the post member. The post member functions as first conductor that contacts a second conductor (31) located on the PCB exposed in the through hole.

14 Claims, 9 Drawing Sheets

ELECTRICAL SYSTEM WITH DEVICE FOR PREVENTING ELECTROSTATIC DISCHARGE

BACKGROUND OF THE INVENTION

1. Field of the Invention

The present invention relates to an electrical system that protects contacts of connectors thereof from electrostatic discharge (ESD).

2. Description of Related Art

Electrical connectors are widely used for making electrical contacts within an electrical system or between electrical systems. During the process of connection and before contacts arranged in an interior of each of the connectors make electrical contact with each other, electrostatic discharge (ESD) caused by static electricity can occur. Excessive voltage, generated by the ESD, can damage the electronic parts mounted on the circuit boards.

A known method of reducing damage to electronic components by ESD is to provide a first ground contact at a male connector and provide a second ground contact at a female connector. Manage to connect the ground contacts before the electrical engagement of the male connector and the female connector. Thus static electricity is discharged by the ground contacts in advance. That precludes the discharge of static electricity between electrical contacts of the male connector and the female connector. However, existence of the ground contacts makes it necessary to provide slots or the like at the male or female connector for accommodating them.

Such a method is disclosed in U.S. Pat. No. 5,356,300. An electrical connector assembly is disclosed having a first connector and a mating connector. The first connector comprises a mating portion, electrical contacts arranged in the mating portion, and alignment posts which project beyond the mating portion. The mating connector provides post-receiving cavities. Wherein, each alignment post defines a slot with a first ground contacts therein along its inner side adjacent to the mating portion. Correspondingly, second ground contacts are provided in the post-receiving cavities of the mating connector for engaging the first ground contacts along the posts. During mating connection of the first connector and the mating connector, prior to electrical contacts of the first connector becomes engaged with the mating connector, the first ground contact becomes engaged with the second ground contact. Thus static electricity is discharged by the first and second ground contacts in advance, protecting the electrical contacts from ESD. However, that slot complicates the alignment post, resulting in increase of producing cost.

It is therefore desired to provide an electrical system with simplified device for protecting contacts of connectors thereof from ESD by discharging static electricity in advance of connection of the connectors.

SUMMARY OF THE INVENTION

An object of the present invention is to provide an electrical system having device for preventing electrostatic discharge but without increasing size nor complicating design.

Accordingly, to achieve the above object, an electrical system of present invention includes a first connector, a second connector mating with the first connector, and a printed circuit board (PCB) on which the second connector is mounted. The first connector has a mating portion with numbers of contacts therein and an elastic post member standing higher than the mating portion. The second connector defines a mating connector fitting section with numbers of contacts therein and a through hole for guiding and receiving the post member. The post member functions as first conductor that contacts a second conductor located on the PCB exposed in the through hole.

Other objects, advantages and novel features of the present invention will become more apparent from the following detailed description of the present embodiment when taken in conjunction with the accompanying drawings.

DETAILED DESCRIPTION OF THE INVENTION

Figure 1:
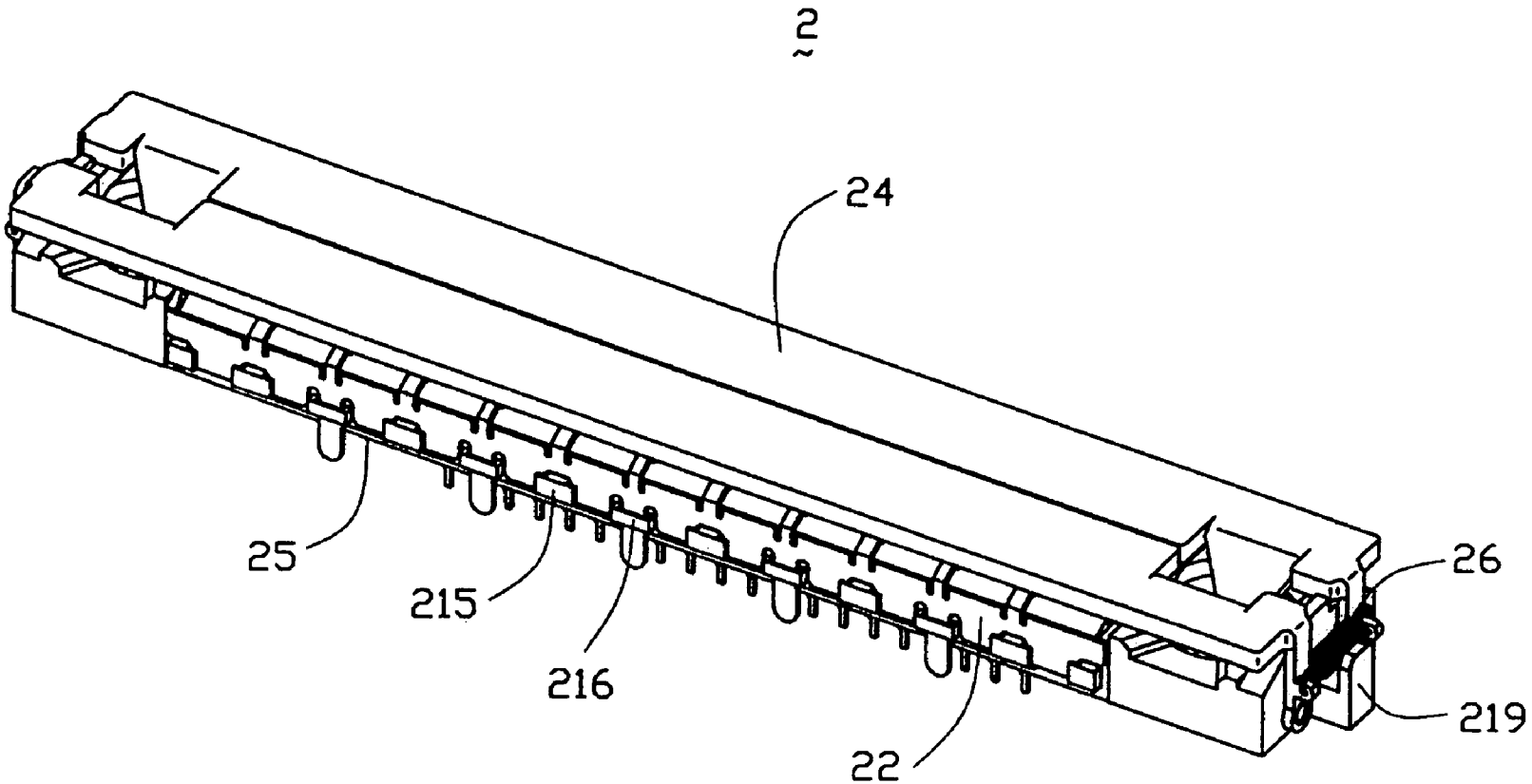
FIG. 1 is a perspective view of a receptacle with a shutter member according to an exemplary embodiment of the present invention.

Reference will now be made to the drawing figures to describe the present invention in detail.

The present invention relates to an electrical connector electrically connected to a mating connector to realize signal transmitting therebetween. According to an exemplary embodiment of the present invention, shown in FIGS. 1–8, that electrical connector is a plug 1 and the mating connector is a receptacle 2, each electrically connecting to a printed circuit board (PCB).

Figure 2:
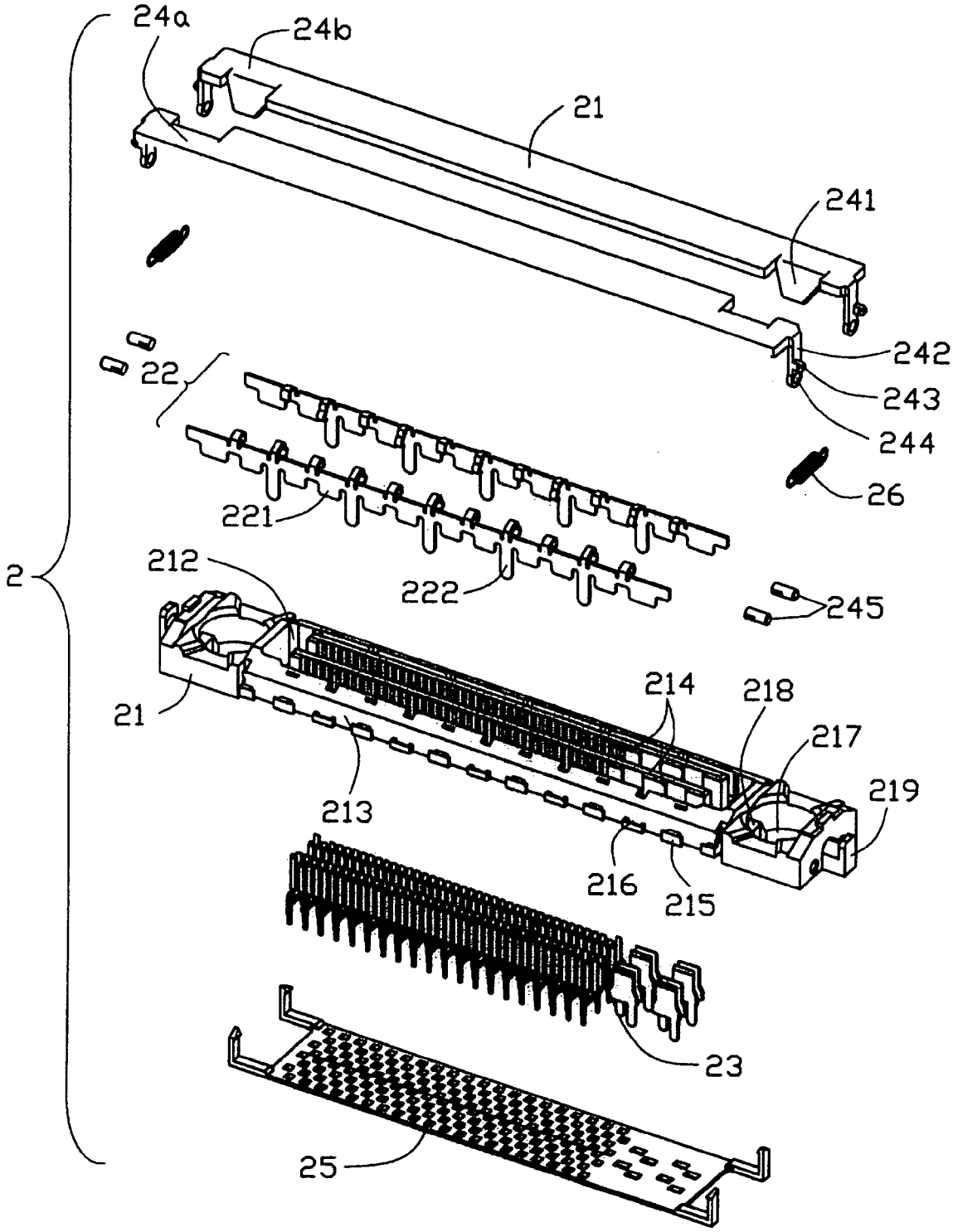
FIG. 2 is an exploded view of the receptacle of FIG. 1.

Referring to FIGS. 1 and 2, the receptacle 2 comprises a lengthways housing 21, a shielding shell 22, a plurality of contacts 23 received in the housing 21, and a shutter member 24. The housing 21 is of a substantially minimized height for exactly accommodating a mating portion 112 of the plug 1 (shown in FIG. 4) and includes a plug fitting section 212 and a pair of guiding holes 217 respectively defined in two end portions therethrough. The plug fitting section 212 having mating tongues 214 therein on which the contacts 23 is arranged. First protuberances 215 and second protuberances 216 are alternately arranged in a row on sidewalls 213 of the plug fitting section 212. Each of the second protuberances 216 defines a slot therethrough along a top-to-bottom direction for receiving a grounding leg 222 of the shielding shell 22. The shielding shell 22 is attached on the exterior of the sidewalls 213, with its retain pieces 221 fitted into the intervals between the first and second protuberances, its grounding legs 222 inserted into the slots of the second protuberances 216. Tines of the contacts 23 and the grounding legs 222 extend through the bottom surface of the housing 21. A tine plate 25 is attached to the bottom surface of the housing 21 to align tips of the tines.

The shutter member 24 comprises a pair of metallic sheets 24*a*, 24*b* linked by a spring 26. Corresponding to the guiding holes 217 in the housing 21, at each end portions of the shutter member 24, there is a pair of guiding plates 241 integrally formed from the metallic sheets 24*a*, 24*b* and tipping down towards the guiding holes 217. Pivot legs 242 extend down from each ends of the metallic sheets 24*a*, 24*b*, and each pivot leg 242 has a lock member 243 for clipping the end of the spring 26 and a keyhole 244 for forelocking the shutter member 24 to the housing 21. In assembly, the spring 26 is supported by a hook-like member 219 formed from two ends of the housing 21, and the keyhole 244 aligns with a corresponding hole (not labeled) in the housing 21 to receive a shaft 245 in, so that the metallic sheets 24*a*, 24*b* are rotatably fastened to the housing 21, covering the plug fitting section 212.

Figure 3:
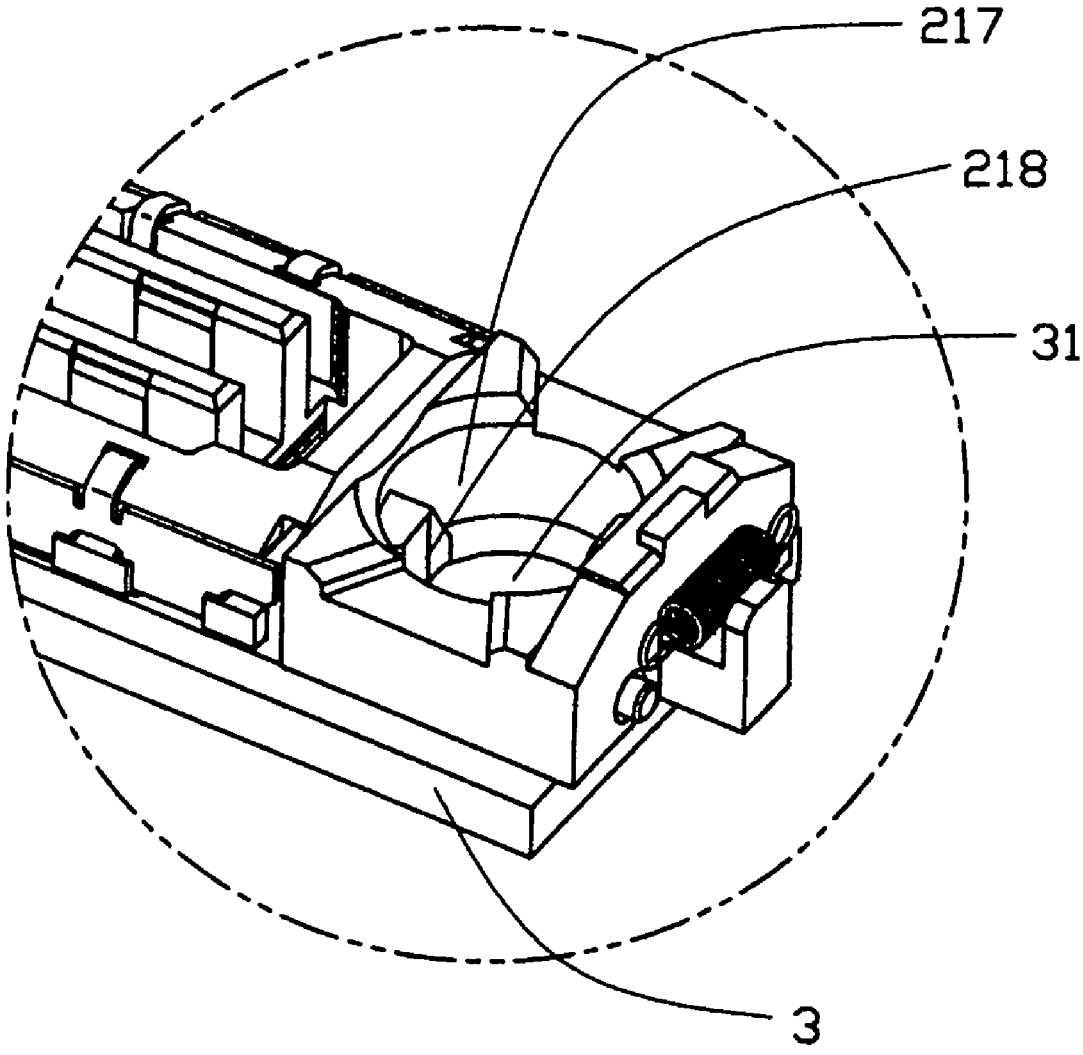
FIG. 3 is a partial magnified view of the receptacle of FIG. 1 after being mounted onto a printed circuit board (PCB), wherein the shutter member is removed.

Referring to FIG. 3, when the receptacle 2 is mounted on a PCB 3 now, the PCB 3 back covers the guiding hole 217 therethrough. Just on the PCB 3 under that guiding hole 217 there is an electric pad 31 functions as a conductor for contacting with another conductor of the plug 1 to prevent electrostatic discharge. And there is a pair of wedgy blocks 218 formed on the inner surface of the guiding hole 217 adjacent to the underlying PCB 3.

Figure 4:
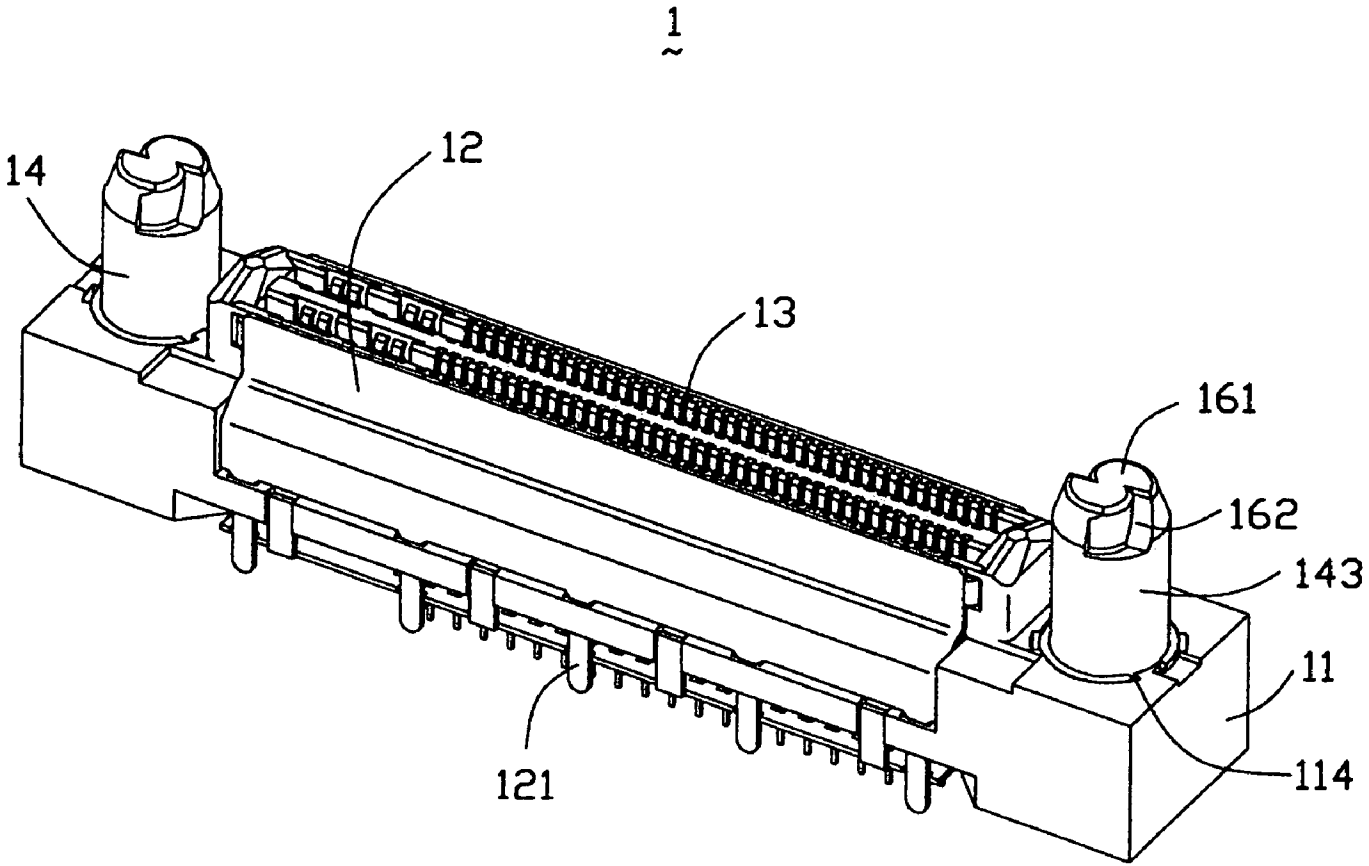
FIG. 4 is a perspective view of a plug with post members for opening the shutter member of the receptacle of FIG. 1.

Referring to FIG. 4, the plug 1 comprises a housing 11, a metallic shielding shell 12, a plurality of contacts 13 received in the housing 11, and a pair of post members 14 respectively provided at two opposite end portion of the housing 11. The shielding shell 12 has a number of grounding legs 121 for being soldered to a second PCB (not shown) on which the plug is mounted. Tines of the grounding legs 121 and the contacts 13 extend through a bottom surface of the housing 11.

Figure 5:
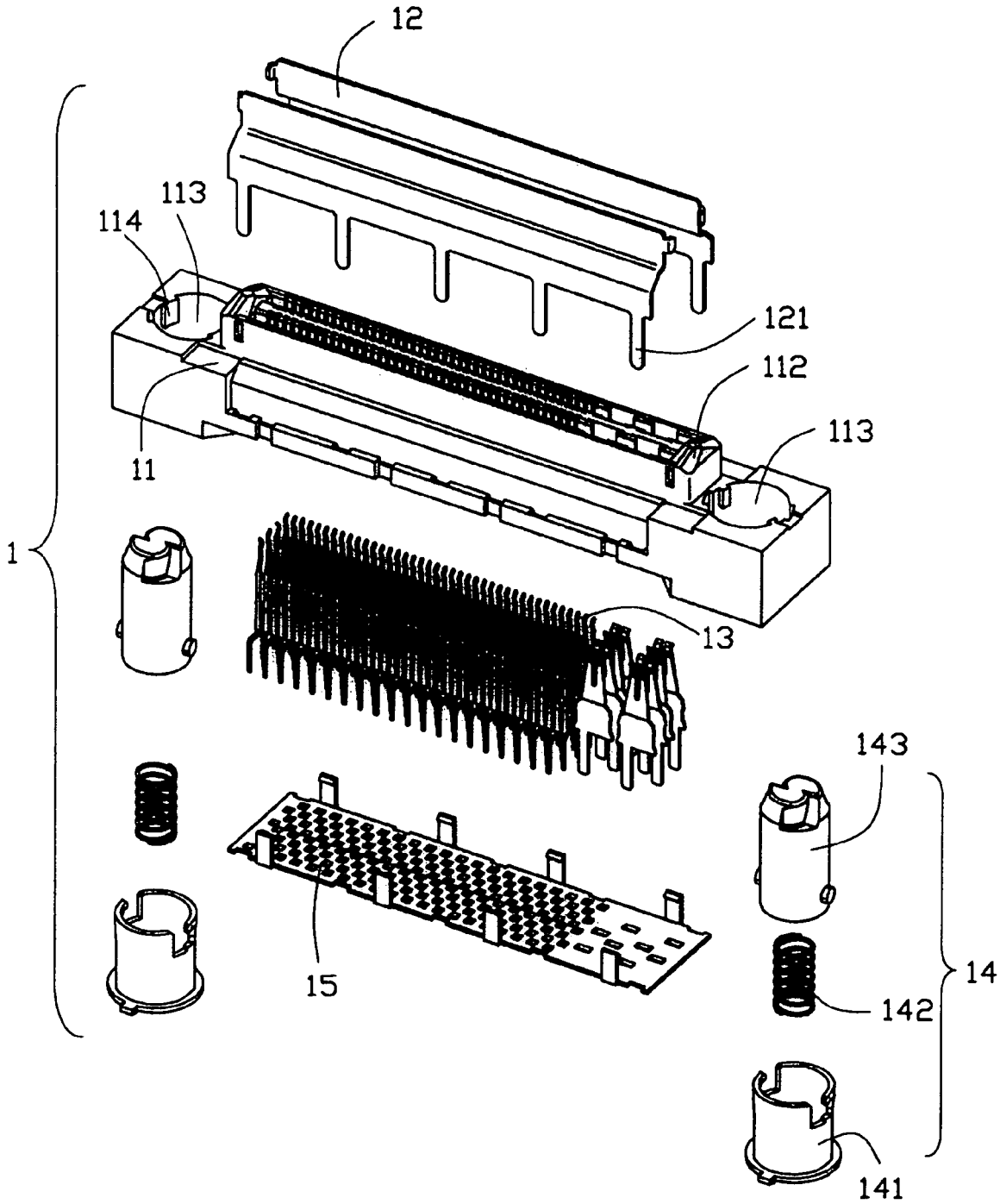
FIG. 5 is an exploded view of the plug of FIG. 4.

Referring to FIG. 5, the plug 1 further comprises a tine plate 15 attached to the tines of the grounding legs 121 and the contacts 13 to align tips of the tines. The mating portion 112 integrally protruding upwards from main body of the housing 11, and a pair of holes 113 respectively defined in two end portions of the housing 11 beside the mating portion 112 for receiving and fastening the post members 14 therein. Contacts 13 are lengthwise arranged in rows in the mating portion 112. Each of the holes 113 has a pair of tubers 114 oppositely protruding from its inner surface.

Each of the post members 14 comprises a fixed portion 141 fixed in the hole 113, a spring member 142, and a movable portion 143. The fixed portion 141 is a metallic annular sleeve and the movable portion 143 is a metallic cylinder partially received in the annular sleeve. The spring member 142 arranged between the fixed portion 141 and the movable portion 143 will push or withdraw the movable portion 143, driving it to move along a mating direction.

Figure 6A:
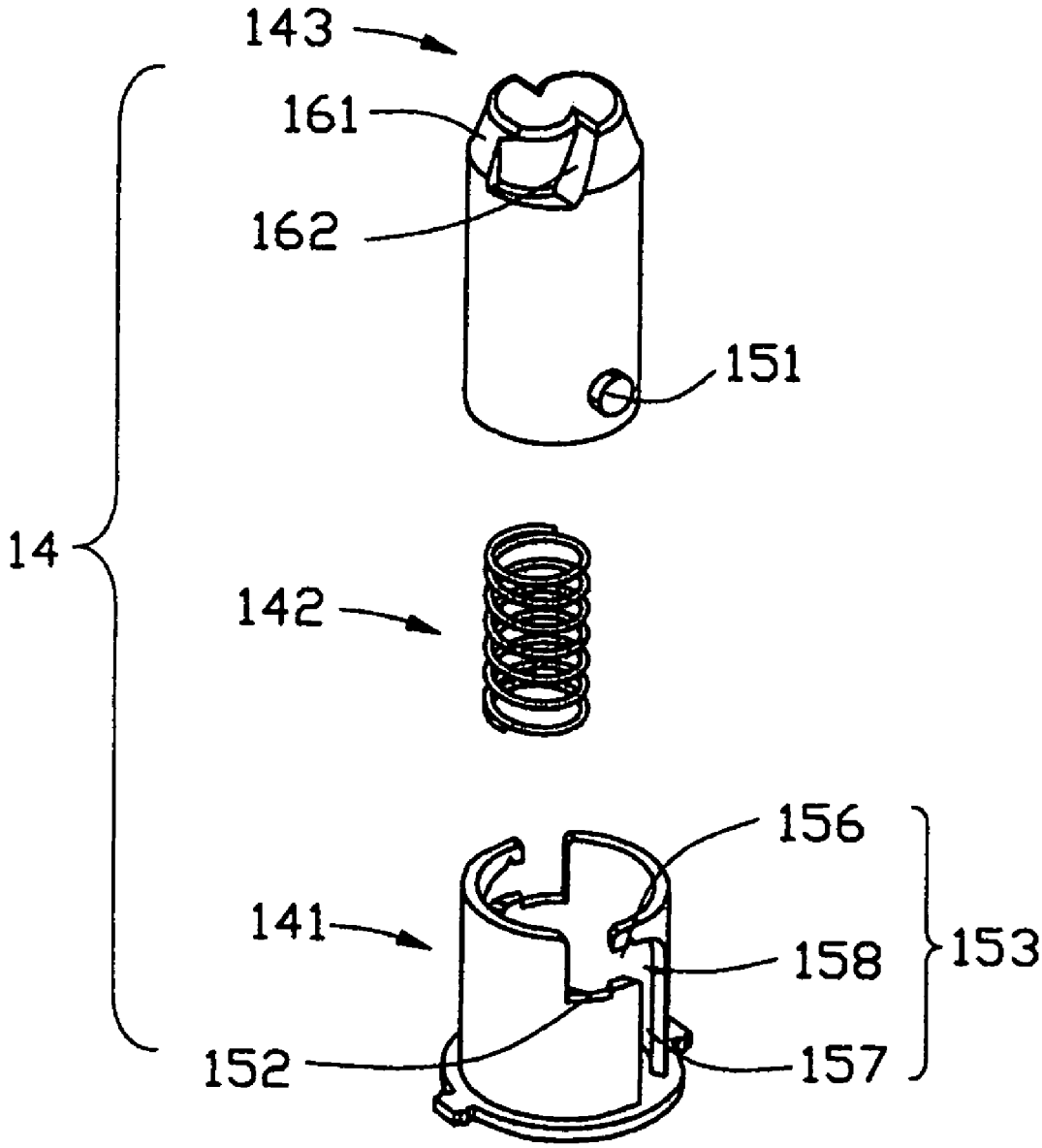
FIG. 6A is an exploded view the post member of the plug of FIG. 5.
Figure 6B:
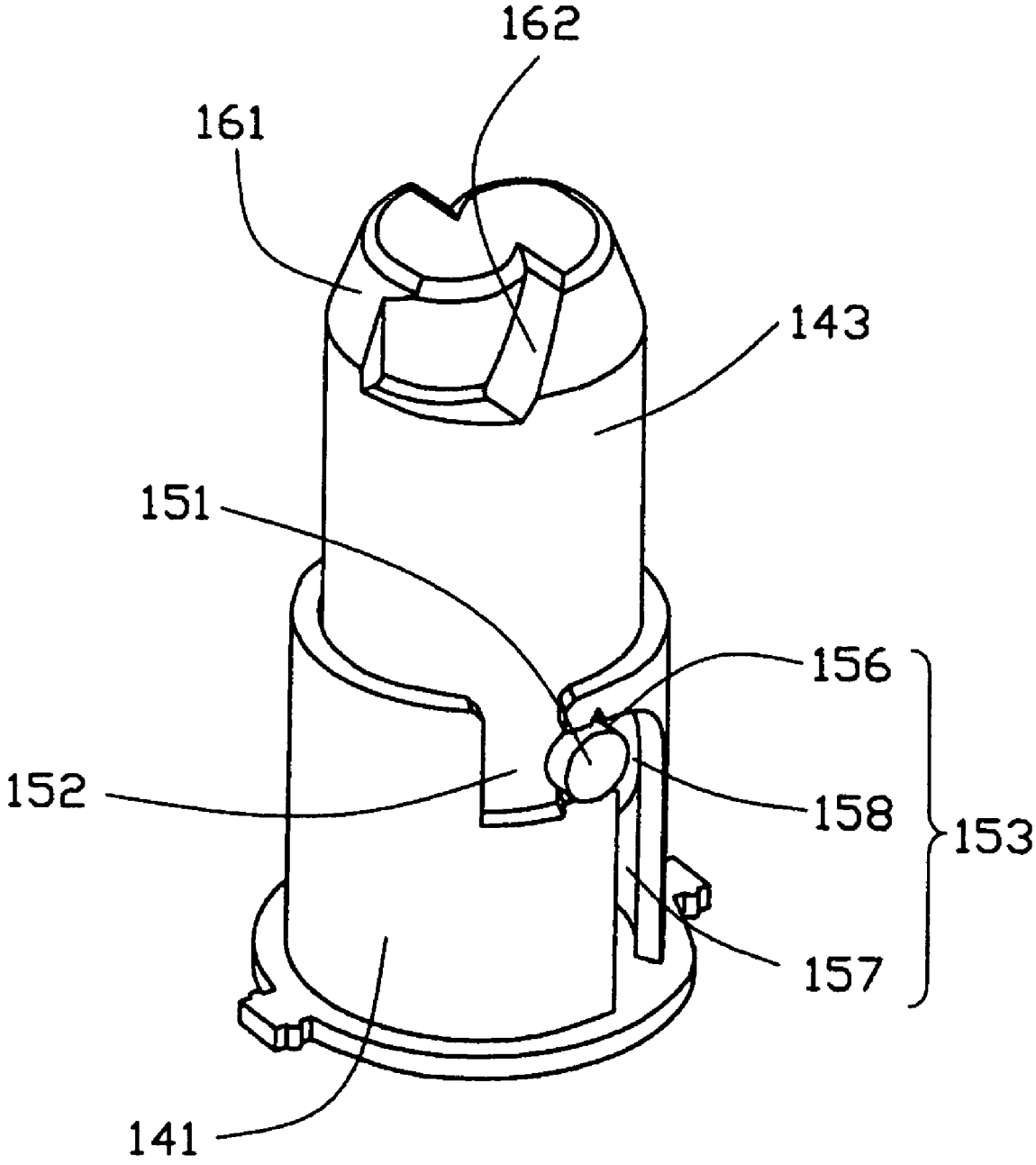
FIG. 6B is an assembly view of the post member of FIG. 6A.

Referring to FIGS. 6A and 6B, the movable portion 143 has a substantially taper-shaped tip portion 161 defining an actuating portion 162 thereon. In this illustrated embodiment, the actuating portion 162 is a pair of guiding slopes symmetrically defined at the tip portion 161 for engaging with the wedgy blocks 218 which function as an actuating member. A pair of cob bulges 151 symmetrically protruding from a lower portion of the movable portion 143 adjacent its bottom face. The fixed portion 141 defines a pair of cutouts 152 corresponding to the tubers 114 on the inner surface of the hole 113 for fixing it therein and a pair of sliding grooves 153 respectively communicating with the cutouts 152. The sliding groove 153 comprises a holding portion 156, a free portion 157 perpendicular to the holding portion 156, and an arc portion 158 joining the holding portion 156 and the free portion 157.

FIG. 6B show the post member 14 in assembly. The cob bulges 151 are fitted flush in the holding portions 156 of the sliding grooves 153 while the lower portion of the movable portion 143 is received in the fixed portion 141.

Figure 7A:
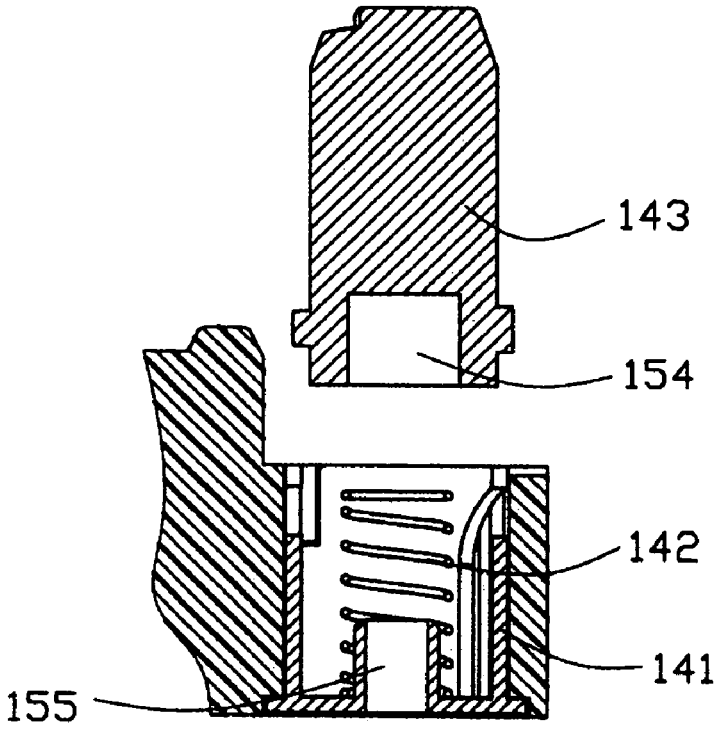
FIG. 7A is a cross-sectional view showing the post member of plug of FIG. 4, wherein a movable portion is separated from a fixed portion thereof.
Figure 7B:
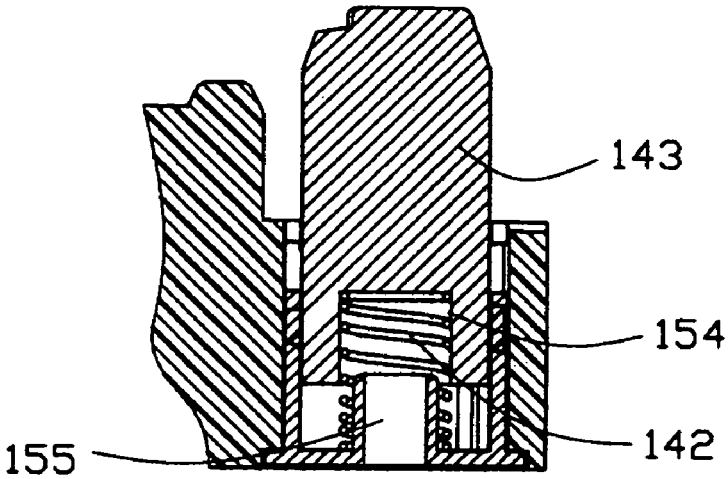
FIG. 7B is a cross-sectional view showing the post member of plug of FIG. 4, wherein the movable portion is assembled to the fixed portion thereof.

Referring to FIGS. 7A and 7B, a cylinder stand 155 rises from an inner bottom face of the fixed portion 141 for fastening one end of the spring member 142 therein. Correspondingly, a downwards-opening receiving recess 154 is defined in a bottom portion of the movable portion 143 for fastening the other end of the spring member 142 therein. The metallic fixed portion 141 is directly connected grounding members of the second PCB.

Figure 8:
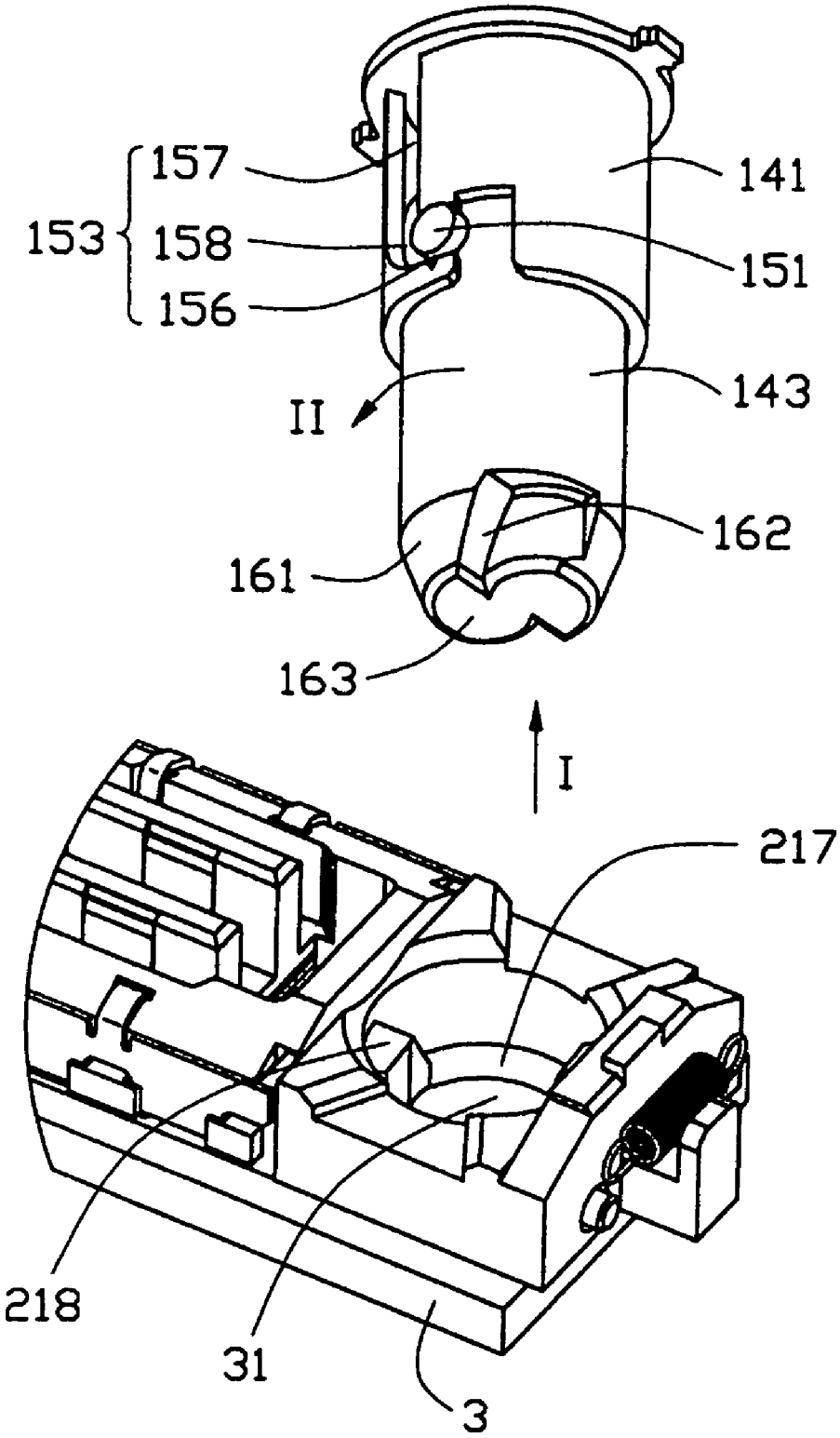
FIG. 8 is a perspective view showing the post member and a guiding hole in the receptacle of FIG. 1 for receiving the post member.

Referring to FIGS. 1, 4 and 8 together, while mating the plug 1 and the receptacle 2 to form a connector assembly, the plug 1 is positioned substantially adjacent to the receptacle 2 such that the tip portion 161 of the post member 14 comes into contact with the guiding plates 241 which is used for guiding the post member 14 to enter the guiding holes 217. Along with advance of the post member 14, the metallic sheets 24*a*, 24*b* are pushed apart to open the shutter member 24 and the plug fitting section 212 of the receptacle 2 is exposed. During this process, the cob bulge 151 on the movable portion 143 is retained in the holding portion 156 of the slide groove 153 and blocked by annular wall of the fixed portion 141 above and under it, making the movable portion 143 be immovable in the mating direction thereby the post member 14 be a rigid body. Thus the post member 14 could provide a force strong enough to open the shutter member to permit the mating portion 112 to enter.

Along with advance of the movable portion 143, the guiding slope (the actuating portion) 162 on the tip portion 161 of the movable portion 143 contacts the wedgy block (the actuating member) 218, then the wedgy block 218 puts a force in a direction I to the guiding slope 162. That force on the guiding slope 162 comes into two different directions that one along a vertical direction and the other along a horizontal direction, wherein the force along the horizontal direction causes the movable portion 143 to rotate along a direction II, synchronously the spring member 142 being twisted. When the bottom terminal of the guiding slope 162 reaches the wedgy block 218, the cob bulge 151 slides exactly to the arc portion 158 of the sliding groove 153 as a result of the rotation of the movable portion 14, and a top face 163 of the movable portion 143 comes into contacting the electric pad 31 on the PCB 3 under the guiding hole 217.

As the metallic post member 14 is grounded to the second PCB on which the plug 1 is mounted, the contact of the movable portion 143 and the electric pad 31 will discharge static electricity in the plug 1 and the receptacle 2. However, at this time, the contacts 13 and the contacts 23 are not yet in contact. So, by the contact of the movable portion 143 and the electric pad 31, static electricity is discharged before the electrical connection between the contacts 13 and the contacts 23.

With the plug 1 further fitted, the PCB 3 applies a force to the movable portion 143. The force pushes the movable portion 143 to compress the spring member 142. During this time, the cob bulge 151 slides in the free portion 157 of the guiding groove 153. Thus, after the plug 1 is fitted in the receptacle 2, the movable portion 143 is completely received in guiding hole 217 of the housing 21 of the receptacle 2 without increasing a height dimension of the receptacle 2 or complicating a layout of the PCB 3 by an added requirement to provide a recess to receive the portion of the post member 14 that goes beyond the receptacle 2.

Once the plug 1 is pulled out from the receptacle 2, the post member 14 is drawn out from the guiding hole 217 as well. Then the spring member 142 is apt to return to original free state from the compressed and twisted state, producing two forces respectively opposite the compressing direction and the twisting direction. That makes the movable portion 143 rotate and move back to the original stationary sate while the cob bulge 151 slides back to holding portion 156.

The disclosure is illustrative only, changes may made in detail, especially in matter of shape, size, and arrangement of parts within the principles of the invention. For example, we may make the hole 113 of the housing 11 in the plug 1 be the fixed portion of the post member 14 instead of the metallic sleeve 141.

What is claimed is:

1. An electrical system comprising:

a first connector having a mating portion with a plurality of first contacts therein, and a post member grounded to a first printed circuit board (PCB) on which the first connector is mounted and protruding beyond the mating portion;

a second connector defining a mating connector fitting section with a plurality of second contacts therein, and a guiding-channel for guiding and receiving the post member; and a second PCB on which the second connector is mounted, the second PCB having a second conductor thereon corresponding to the guiding-channel, the second conductor electrically connecting the post member before the first and second contacts come into contact.

2. The electrical system as described in claim 1, wherein the post member is made from a metallic material.

3. The electrical system as described in claim 1, wherein the second conductor is an electric electronic pad on the second PCB exposed in the guiding-channel.

4. The electrical system as described in claim 1, wherein the post member is elastic and comprises a fixed portion, a movable portion movable relative to the fixed portion, and an elastic member linking the fixed portion and the movable portion, the post member being able to be completely received within the guiding-channel after being compressed.

5. The electrical system as described in claim 4, wherein the fixed portion is an annular sleeve assembled in a hole of the first connector, the movable portion is a cylinder.

6. The electrical system as described in claim 5, wherein the elastic member is a spring with one end thereof fastened in the annular sleeve and with the other end thereof fastened to an underside of the cylinder.

7. The electrical system as described in claim 6, wherein the second connector has a shutter closing the mating connector fitting section, and the shutter is openable by the elastic post member.

8. The electrical system as described in claim 7, wherein the annular sleeve defines a groove in the annular wall thereof, the cylinder has a bulge formed from an exterior surface thereof and slidably received in the groove.

9. The electrical system as described in claim 8, wherein the groove comprises a holding portion along a mating direction and a free portion extending substantially perpendicularly to the free portion.

10. The electrical system as described in claim 9, wherein the bulge is in the holding portion before the shutter is opened, and the bulge slides into the free portion after the shutter is fully opened.

11. The electrical system as described in claim 10, wherein the cylinder defines a slope on a tip portion thereof, and wherein the second connector has a block engaging with the slope for driving the bugle to slide from the holding portion to the free portion.

12. An electrical connector assembly comprising:

a first connector having a mating portion with a plurality of first contacts therein, and an elastic post member protruding beyond the mating portion in an original state; and a second connector having a mounting face for mounting on a printed circuit board (PCB), a mating face, a mating connector fitting section opening to the mating face and receiving a plurality of second contacts therein, and a guiding-channel extending through the mating face and the mounting face for guiding and receiving the elastic post member;

the elastic post member reaching the mounting face of the second connector through the guiding-channel before the first and second contacts come into contact.

13. The electrical connector assembly as described in claim 12, wherein the elastic post member is made from a metallic material and is connected to a ground line of another PCB on which the first connector is mounted.

14. The electrical connector assembly as described in claim 12, wherein the post member comprises a fixed portion, a movable portion movable relative to the fixed portion, and an elastic member linking the fixed portion and the movable portion, so the post member is able to be completely received within the guiding-channel after being compressed.

* * * * *